US006880678B1

(12) United States Patent
Schneider et al.

(10) Patent No.: US 6,880,678 B1
(45) Date of Patent: Apr. 19, 2005

(54) DEVICE FOR CARRYING OUT WORK IN AN ELEVATOR SHAFT

(75) Inventors: Marcel Schneider, Kriens (CH); Urs Ammon, Ebikon (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/257,846

(22) PCT Filed: Apr. 20, 2000

(86) PCT No.: PCT/CH00/00228

§ 371 (c)(1),
(2), (4) Date: Jan. 21, 2003

(87) PCT Pub. No.: WO01/81229

PCT Pub. Date: Nov. 1, 2001

(51) Int. Cl.[7] ..... B66B 13/14
(52) U.S. Cl. ..... 187/314
(58) Field of Search ..... 187/239, 410, 187/413, 414, 324, 404, 406, 253, 254, 266, 240

(56) References Cited

U.S. PATENT DOCUMENTS

| | | | | |
|---|---|---|---|---|
| 6,202,801 B1 | * | 3/2001 | Muller et al. | 187/401 |
| 6,481,537 B1 | * | 11/2002 | Malone et al. | 187/391 |
| 6,691,833 B1 | * | 2/2004 | Elsener et al. | 187/266 |

FOREIGN PATENT DOCUMENTS

| | | | | |
|---|---|---|---|---|
| EP | 870722 A1 | * | 10/1998 | B66B/11/02 |
| JP | 02291377 A | * | 12/1990 | B66B/5/00 |
| JP | 05043162 A | * | 2/1993 | B66B/7/00 |
| JP | 05097357 A | * | 4/1993 | B66B/11/02 |
| JP | 05147845 A | * | 6/1993 | B66B/5/00 |

OTHER PUBLICATIONS

Patent Abstracts of Japan, 09263372, (Mitsubishi Denki Bill Techno Service KK), Kawahara, Toshiaki, Oct. 1997.*

* cited by examiner

*Primary Examiner*—Jonathan Salata
(74) *Attorney, Agent, or Firm*—Schweitzer Cornman Gross & Bondell LLP

(57) ABSTRACT

According to the invention, the maintenance scaffold (10) is assembled as follows: in a first step, an illuminated ceiling, which lies below the collapsed maintenance scaffold (10), is taken down. Suspension members (17) are then brought into a vertical position. The platform (12) and flap (13) are lowered vertically until they reach the bearings (19) of the suspension members (17). Before mounting the platform (12), the maintenance personnel must unfold the ladder (18) and open the flap (13) upwards. Once the personnel has mounted the platform (12), the flap is closed (13) by means of a handle, in such a way that the entire platform can be used as a working scaffold. With the maintenance scaffold (10) in the working position, the height for a regulatory passage (U) is maintained, as determined by the distance between the cabin ceiling (14) and the platform (12).

6 Claims, 4 Drawing Sheets

DEVICE FOR CARRYING OUT WORK IN AN ELEVATOR SHAFT

The invention relates to a device for carrying out work in an elevator hoistway in which an elevator car can be caused to travel which has a maintenance platform from which the work can be carried out.

BACKGROUND OF THE INVENTION

From patent specification JP 05097357 a device for the maintenance of hoistway equipment of an elevator installation has become known. Fitted inside an elevator car is a stage which can be folded out from the car wall to serve as a standing surface for maintenance staff while carrying out maintenance work. Provided in the roof of the elevator car is a trapdoor which can be closed with a cover, and which permits access to the hoistway equipment. Maintenance staff stand on the stage, and with the upper part of their body projecting from the car, can carry out the work in the hoistway.

A disadvantage of the known device is that the car wall which carries the stage has to be mechanically strengthened, and also that for folding and holding the stage fixtures and fittings are necessary on which the elevator users can become caught by items of clothing or other objects, because the stage is in the area which users of the elevator occupy.

From patent specification JP 09263372 an elevator car has become known which has a lowerable ceiling which serves the maintenance staff as a working stage for maintenance work in the elevator hoistway. The car ceiling is hung at each corner on a rope, there being provided on each side of the elevator car a rope drum to take the ropes of one side. The rope drums are connected by means of an axle. To lower and raise the car ceiling, the rope drums are set in rotating motion by means of a manual crank. Operation of the rope drums, and access to the working stage, is effected from outside the elevator car.

A disadvantage of the known device is that an involved mechanism for lowering and raising is necessary and must be transported with the elevator car. Also disadvantageous is that to operate the mechanism, and for access to the working stage, the maintenance staff must climb onto the elevator car, which is associated with substantial dangers.

BRIEF DESCRIPTIONS OF THE INVENTION

It is here that the invention aims to provide a remedy. The invention as described in claim 1 provides a solution to avoiding the disadvantages of the known device and creating a device for working in an elevator hoistway which does not present a hazard either to the maintenance staff or to the elevator users in the elevator car. The invention is in the form of a maintenance platform that is normally situated outside the area occupied by the users of the elevator car.

The platform has a stage that can be positioned within the car for working purposes to function as a standing surface for the maintenance staff. The platform may be, for example located on or formed as part of the elevator car ceiling. The advantages achieved by the invention are essentially to be seen in that there is no danger to the users of the elevator car of injuring themselves on parts of the maintenance platform because the maintenance platform is situated outside the area they occupy, i.e. above head height of the users of the elevator car. Furthermore, on the car walls there are no targets of attack for vandalism as, for example, edges, hinges, joints, etc. The car interior is not impaired by the maintenance platform. In terms of sales strategy, the aesthetic presentation of the car interior is of great economic significance.

The maintenance platform according to the invention completely fulfils this requirement, for example by being situated out of sight under the illuminated ceiling, or by the maintenance platform being fitted into the ceiling without any joint. While maintenance work is carried out, the ceiling is protected against soiling and/or damage. The maintenance staff only treads on the upper side of the ceiling, which is not visible during normal operation of the elevator. The maintenance platform according to the invention can also support heavier loads, so that parts which must be installed in, or have been removed from, the hoistway can be temporarily placed on the maintenance platform. The position of the trapdoor, or more specifically the opening in the roof of the elevator car, for carrying out maintenance work in the elevator hoistway can be chosen in such a way that hoistway equipment located in the hoistway headroom does not project over the trapdoor, the maintenance platform lying in the projection of the trapdoor and it also having a sufficiently large surface for standing on. The position of the trapdoor, and the sufficiently large standing surface and ability to support heavier loads of the maintenance platform, ensure the safety of the maintenance staff.

BRIEF DESCRIPTION OF THE DRAWINGS

The invention is described in more detail below by reference to drawings illustrating an exemplary embodiment. The drawings show.

DETAILED DESCRIPTION OF THE INVENTION

Figure 1:
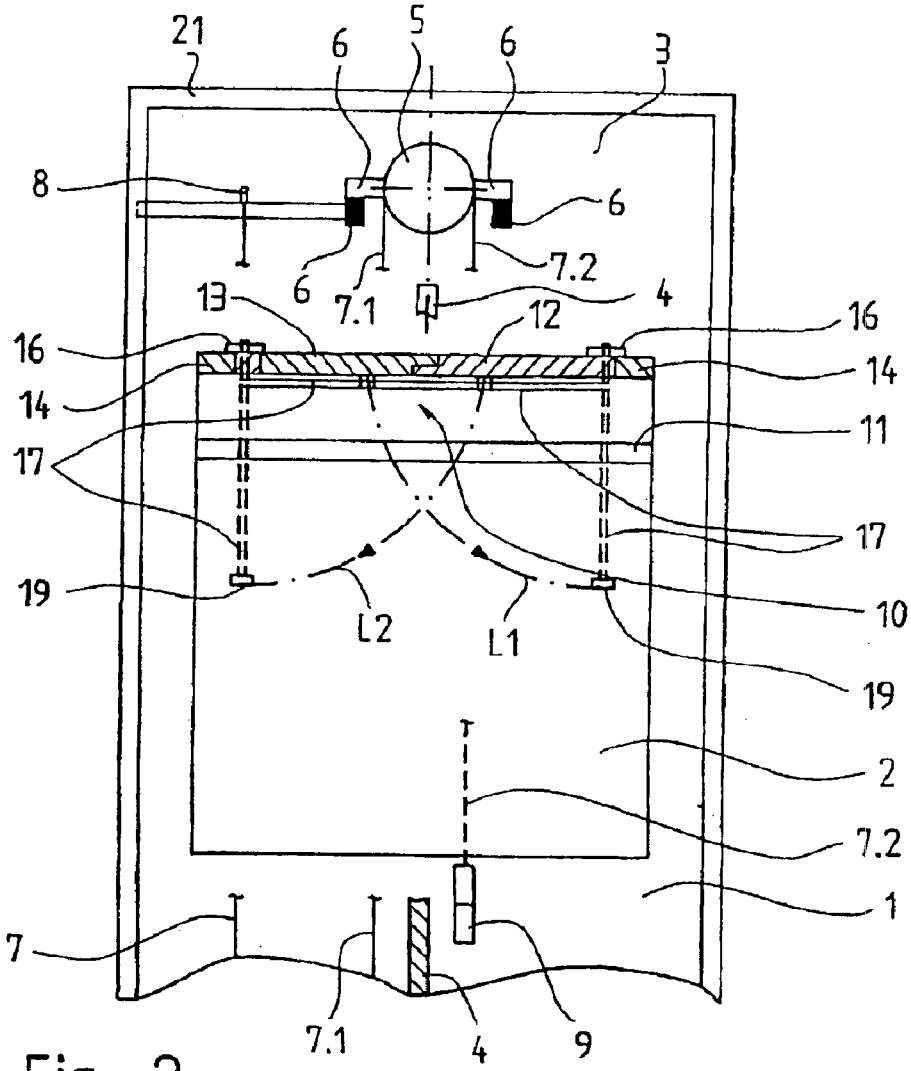
FIG. 1 a diagrammatic representation of an elevator car standing at the uppermost stop in an elevator hoistway with reduced hoistway headroom.
Figure 2:
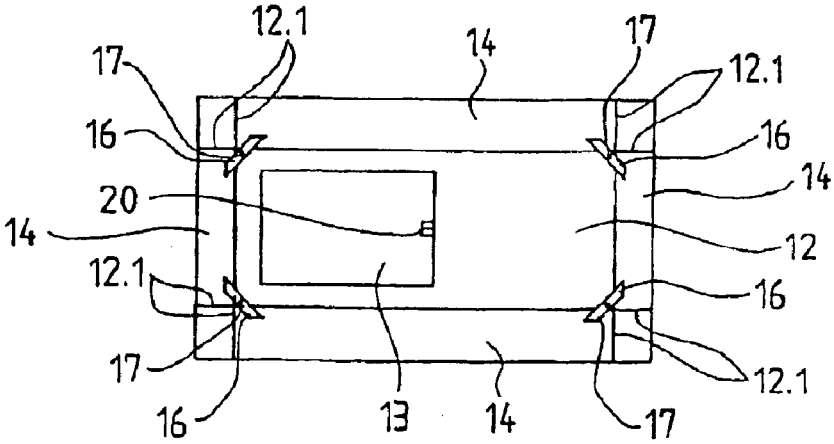
FIG. 2 a plan view of the elevator car
Figure 3:
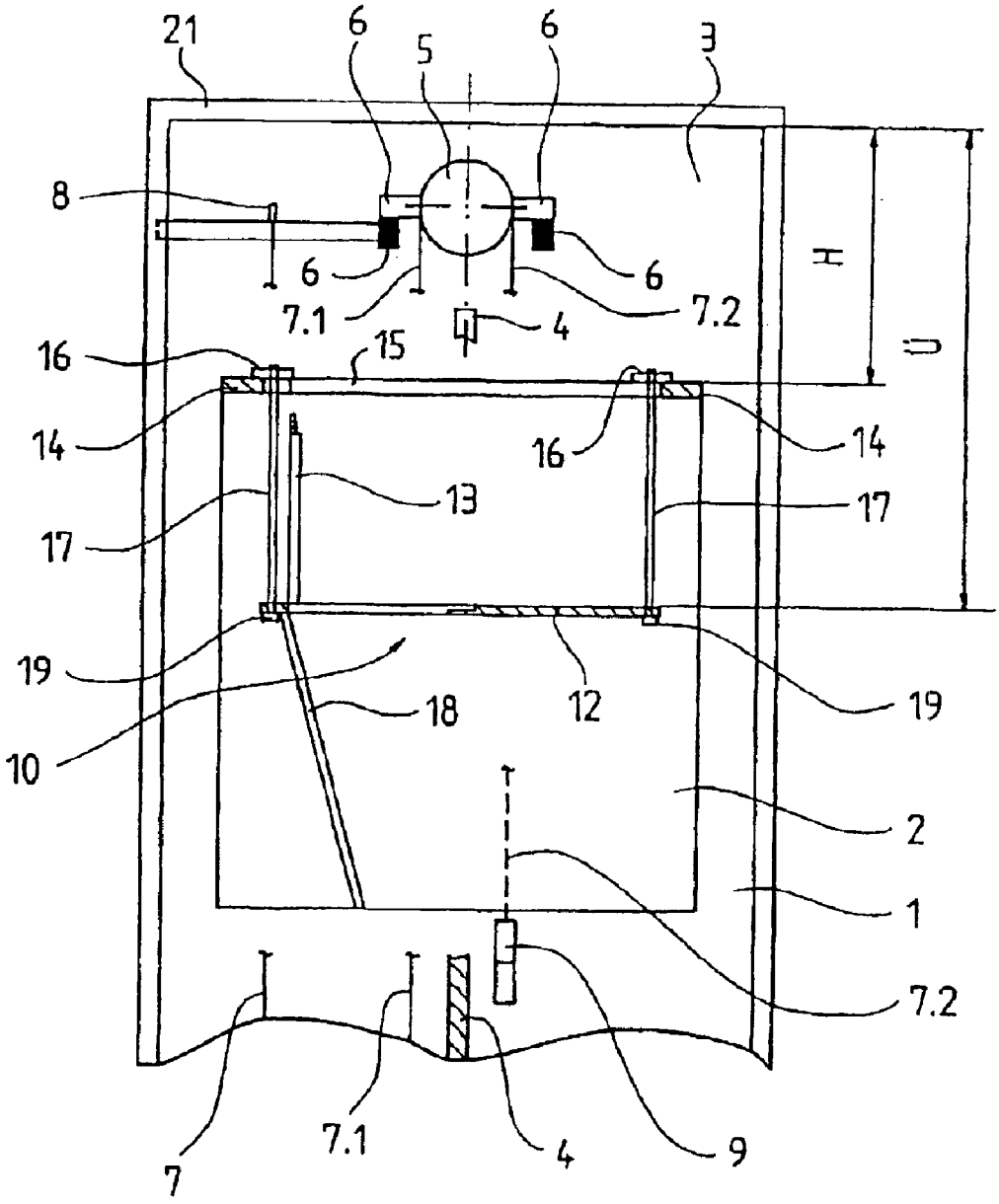
FIG. 3 the elevator car of FIGS. 1 and 2 with a maintenance platform according to the invention in its working position.

In FIGS. 1 to 3, 1 indicates an elevator hoistway in which an elevator car 2 can be caused to travel. Located in the hoistway headroom 3 above a guiderail 4 for the elevator car 2 is a traction sheave 5 which is connected to a drive which is not shown. The traction sheave 5 is supported by, for example, a wall bracket 6. The counterweight end of a suspension rope 7, which passes over the traction sheave 5 and has a 2:1 roping arrangement, is indicated by 7.1, and the car end of the suspension rope 7 is indicated by 7.2. On the counterweight side, the suspension rope ends at a first dead-end hitch 8. On the car side, the rope 7.2 passes over a first pulley referred to as an underslung pulley 9, then over a second underslung pulley (not shown), and terminates at a second dead-end hitch which is also not shown. The 2:1 roping arrangement is especially suitable for the machine-room-less elevator layout shown, where the elevator car 2 is carried by the two underslung pulleys 9 and can be caused to travel almost up to the drive unit which is located in the hoistway 1. A maintenance platform indicated with 10 is located above an illuminated ceiling 11. A standing surface from which the work in the elevator hoistway 1 can be carried out, and which is referred to as a stage, is indicated with 12. The stage 12, which is equipped with a flap 13, forms a part of the car ceiling 14. FIGS. 1 and 2 indicate the maintenance platform 10 according to the invention in its out-of-use position. The stage 12 and the flap 13 close a trapdoor, or more specifically an opening in the ceiling 15, and form a part of the ceiling 14. The position and size of the opening in the ceiling 15 is so chosen that hoistway equipment located in the hoistway headroom 3, as for example the drive, does not project over the opening in the ceiling 15. Hangers 17 located on suspension brackets 16 are folded away. Arrows with broken lines L1, L2 indicate the movement of the hangers 17 from their out-of-use position into the working position shown in FIG. 3, in which a ladder 18 located on the underside of the stage 12 is folded down. Not shown are struts which link the hangers 17 and give rigidity to the maintenance platform 10.

The hangers 17 can be replaced by ropes. In this case, as shown in FIG. 2, to give rigidity to the maintenance platform 10, arms indicated by 12.1 reaching from the stage 12 to the car wall are folded out or pulled out from the stage 12.

In a further variant, the maintenance platform 10 has neither a flap 13 nor a ladder 18. In this case, access to the maintenance platform 10 is either direct or by means of a stepladder from the landing door or the car door.

The maintenance platform according to the invention is set up, or brought from the out-of-use position shown in FIGS. 1 and 2 into the working position shown in FIG. 3, in the following steps. In a first step, the illuminated ceiling 11 is removed. The hangers 17 are then brought into the vertical position as shown with arrows and broken lines. After this, the stage 12 with the flap 13 is lowered vertically as far as the bearing surfaces 19 of the hangers 17. Before the stage 12 is stepped onto, the ladder 18 is folded down and the flap 13 is folded up. After the stage 12 is stepped onto, the flap 13 is closed by means of a handle 20, so that the entire surface of the stage is available as a maintenance platform. In the reverse sequence, the maintenance platform according to the invention is brought from the working position shown in FIG. 3 into the out-of-use position shown in FIGS. 1 and 2.

Figure 4:
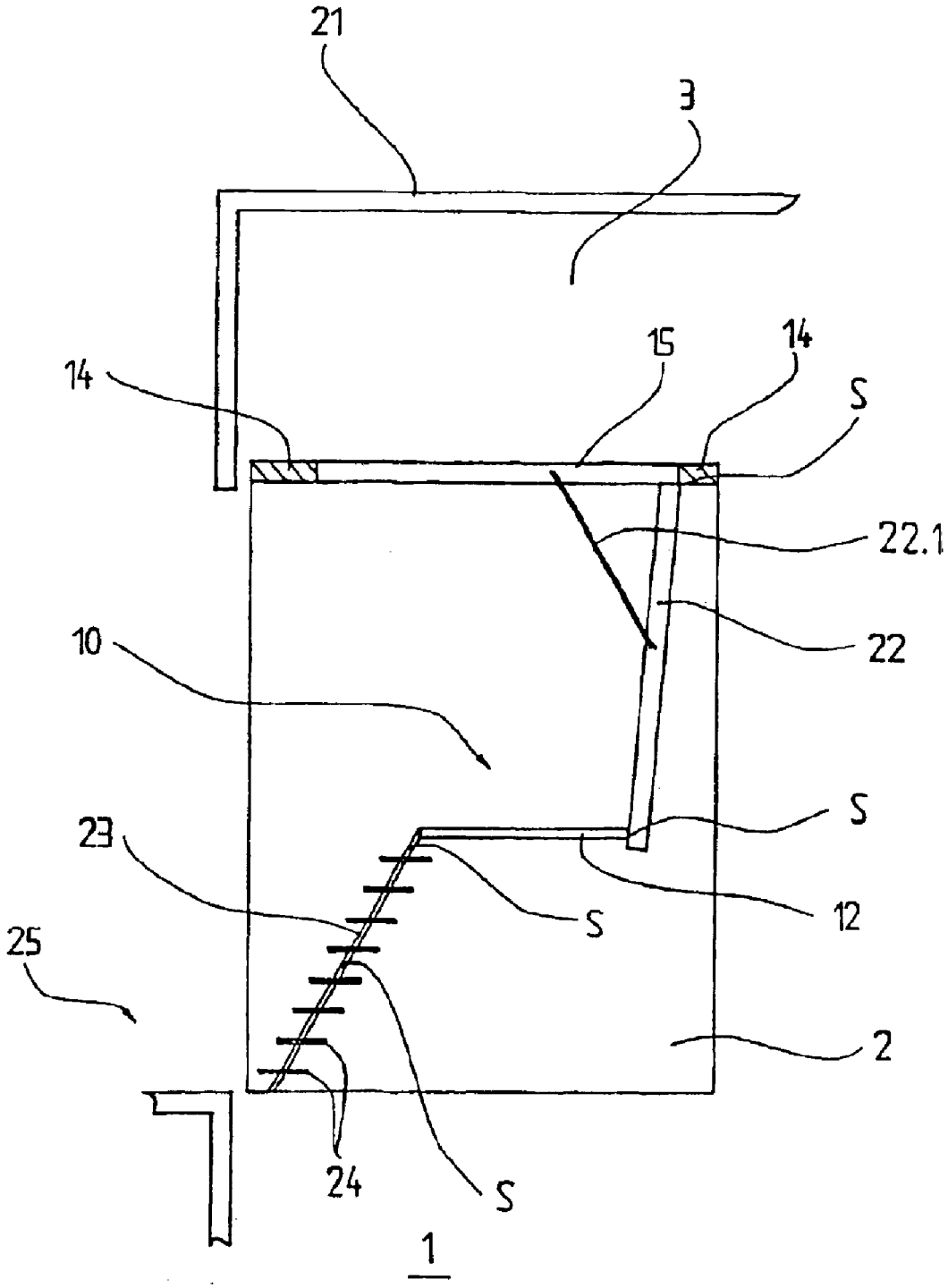
FIG. 4 a variant embodiment of the maintenance platform.

FIG. 4 shows a further variant embodiment of the maintenance platform 10, which essentially consists of a cover 22, a stage 12, and a step unit 23 with steps 24. Cover 22, stage 12, and step unit 23 can be folded at points S by means of, for example, hinges. In the out-of-use position, the cover 22 closes the opening in the ceiling 15 and forms a part of the ceiling 14. Stage 12 and step unit 23 are then folded together and located on the ceiling 22. To carry out work in the elevator hoistway 1, the cover 22 is folded down and the stage 12 and step unit 23 folded out. Access to the stage 12 is obtained from the landing 25 up the steps 24. To assure the necessary rigidity of the maintenance platform 10, supports and/or struts and/or jointed arms are provided. Folding aids, in the form of springs or gas-pressure springs, are also conceivable.

Figure 5:
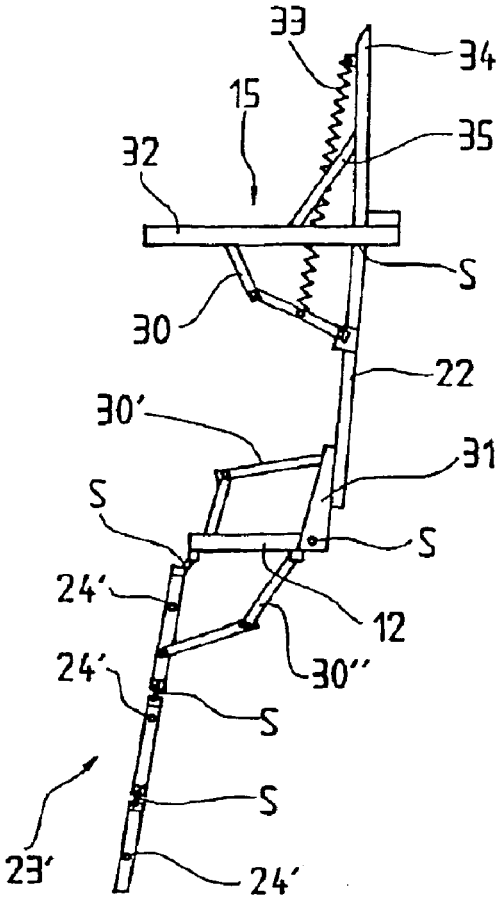
FIGS. 5 and 6 details of the variant embodiment according to FIG. 4.
Figure 6:
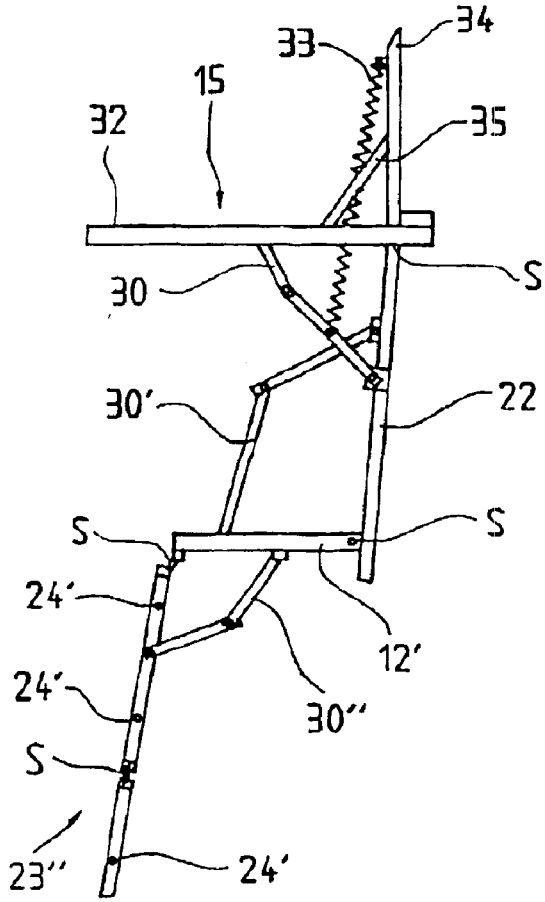

The side elevations of FIGS. 5 and 6 show details of the variant embodiment of FIG. 4 in the working position. In FIGS. 5 and 6 the step unit 23 according to FIG. 4 consists of a folding two-part ladder 23" or three-part ladder 23', which at the points S has hinges for folding the ladder 23. Instead of the foldable ladder there can be a telescopic ladder. In FIGS. 5 and 6 the steps 24 of FIG. 4 are implemented as ladder rungs 24'. A jointed arm 30" stabilizes the ladder 23 relative to the stage 12 or 12' respectively. In FIG. 5 the stage 12 is fastened to a slider 31 which, when the maintenance platform 10 is folded away, is pushed upward along the cover 22 until the stage 12 is flush with the edge of the cover. The slider 31 and the stage 12 or 12' respectively are connected with a jointed arm 30'. A jointed arm 30 connects the cover 22 to an upper car sling 32 which is a part of the ceiling 14 and to which the side walls of the elevator car are fastened. The jointed arms 30, 30', 30" are preferably implemented as toggle joints and effect a rigid connection of cover 22, stage 12 or 12' respectively, and ladder 23' or 23" respectively, to each other and to the car sling 32. The cover 14 itself is not shown in FIGS. 5 and 6. Acting on the jointed arm 30 of the cover 22 is a spring 33 whose other end is connected to a support 34. Support 34 and car sling 32 are connected by means of a strut 35. The force of the spring 33 is such that the maintenance platform 10 can be raised and returned to the out-of-use position with a small force. The maintenance platform 10 can be fitted with jointed arms 30, springs 33, supports 34, and struts 35 on one or both sides.

In a further variant embodiment, the opening in the ceiling 15 is closed by a cover which forms part of the ceiling 14 and can also be used as a stage 12. When work is carried out in the elevator hoistway 1, the cover is manually removed from the ceiling 14 and placed, for example, over the handrails fastened on opposite walls, and its height adjusted if necessary by means of supports.

In a further variant embodiment the maintenance platform, or parts of the maintenance platform, can also be accommodated in, for example, a cabinet adjacent to a hoistway door. To carry out work, the maintenance staff hang it or stand it in the car, and put away in the same cabinet any parts which have been removed or are not needed for assembly of the maintenance platform.

With its reduced hoistway headroom 3, the machine-room-less elevator layout shown does not provided sufficient height H to allow an overtravel (distance between the car ceiling 14 and hoistway ceiling 21) as required by regulations of, for example, one meter for carrying out maintenance from the car roof. With the maintenance platform 10 according to the invention in its working position, the required overtravel Ü is obtained because it is no longer determined by the distance between the car ceiling 14 and the hoistway ceiling 21 but by the distance between the stage 12 and the hoistway ceiling 21, and because no hoistway equipment in the hoistway headroom 3 projects over the opening in the ceiling 15.

What is claimed is:

1. A device for carrying out work in an elevator hoistway from within an elevator car able to travel within the hoistway and having an opening in a ceiling through which access to the hoistway is enabled, comprising a cover for the ceiling opening pivotally connected to the ceiling at a first end of the cover; a stage having a surface to stand on within the elevator car for the purpose of carrying out work in the elevator hoistway pivotally attached to a second end of the cover; and a step unit pivotally connected to the stage for accessing the stage from an area below the stage occupied by the users of the elevator car, the stage and step unit foldable upon a surface of the cover such that, in a folded-up position with the cover closing the ceiling opening, the stage and ladder are situated outside an area occupied by users of the elevator car.

2. The device according to claim 1, wherein the step unit is a foldable or telescopic ladder.

3. The device according to claim 1 or 2, further characterized in that on the ceiling of the elevator car there is a support to which a spring is attached for raising the cover.

4. The device according to claim 1 or 2, further comprising locking means for selectively maintaining the stage and step unit in unfolded working position rigidly connected to each other.

5. The device of claim 1 or 2 wherein the surface of the cover upon which the stage and step means are folded is a surface that, with the cover closed, faces an exterior of the car.

6. The device according to claim 1 or 2 characterized in that in a working position the stage is held at a height at which a prescribed overtravel (Ü) is obtained.

* * * * *